US009195221B2

(12) United States Patent
Oshita et al.

(10) Patent No.: US 9,195,221 B2
(45) Date of Patent: Nov. 24, 2015

(54) TIMER AND WATCH

(71) Applicant: CASIO COMPUTER CO., LTD., Shibuya-ku, Tokyo (JP)

(72) Inventors: Yuki Oshita, Tokyo (JP); Junro Yano, Hachioji (JP); Yohei Kawaguchi, Akishimia (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/663,307

(22) Filed: Mar. 19, 2015

(65) Prior Publication Data

US 2015/0268640 A1 Sep. 24, 2015

(30) Foreign Application Priority Data

Mar. 24, 2014 (JP) ..... 2014-059659

(51) Int. Cl.

| | |
|---|---|
| ***G04R 60/10*** | (2013.01) |
| ***G04B 37/00*** | (2006.01) |
| ***G04R 60/12*** | (2013.01) |
| *G04B 37/22* | (2006.01) |

(52) U.S. Cl.

CPC ..... *G04R 60/12* (2013.01); *G04B 37/225* (2013.01); *G04R 60/10* (2013.01)

(58) Field of Classification Search

CPC ..... G04B 37/12; G04B 37/225; G04B 37/11; G04R 60/10; G04R 60/12; G04G 21/04

USPC ..... 368/280, 286, 297, 316

See application file for complete search history.

(56) References Cited

U.S. PATENT DOCUMENTS

| | | | | |
|---|---|---|---|---|
| 7,639,569 | B2 * | 12/2009 | Yano et al. | 368/47 |
| 7,976,214 | B2 * | 7/2011 | Hiranuma et al. | 368/309 |
| 8,500,325 | B2 * | 8/2013 | Ueno | 368/287 |
| 8,556,500 | B2 * | 10/2013 | Hiranuma | 368/295 |
| 8,714,814 | B2 * | 5/2014 | Altenhoven et al. | 368/316 |
| 8,876,371 | B2 * | 11/2014 | Behrend et al. | 368/286 |
| 2006/0164921 | A1 * | 7/2006 | Gunnarsson et al. | 368/47 |
| 2009/0003141 | A1 * | 1/2009 | Ozawa | 368/294 |

FOREIGN PATENT DOCUMENTS

JP 2001289967 A 10/2001

* cited by examiner

*Primary Examiner* — Sean Kayes

(74) *Attorney, Agent, or Firm* — Holtz, Holtz, Goodman & Chick PC

(57) ABSTRACT

A timer includes: a case body made of synthetic resin; an outer case made of synthetic resin, located above the case body and extending to a portion of an upper face of a watch glass; a reinforcement member made of metal embedded in the case body to prevent deformation of the case body when the watch glass is fit thereto and ensure airtightness; and an antenna arranged inside the case body and beneath the reinforcement member, wherein the reinforcement member is embedded in the case body in no electrical continuity with a ground potential.

16 Claims, 5 Drawing Sheets

TIMER AND WATCH

BACKGROUND OF THE INVENTION

This invention relates to a timer used in watches, portable telephones, and electronic devices such as personal digital assistants, and a watch having the timer.

As taught in JP 2001-289967 A that is a Japanese Patent Document, for example, a structure of a watch case in which an annular member made of metal is fixed to a circumferential groove provided in a case body made of synthetic resin, a glass fixing frame made of metal is fixed to an inner circumferential surface of the annular member, and a cover member is attached to the top of the glass fixing frame and the annular member is known.

With such a watch, however, when an antenna is arranged inside the watch case, a switch button is in electrical continuity with the glass fixing frame made of metal and the glass fixing frame made of metal is at ground potential so as to prevent damage to an electronic circuit caused by electrostatic discharge, which thus affects the electric field radiated by the antenna, and leads to lower gain characteristics of the antenna and lower reception performance of the antenna.

This invention is directed to a timer capable of improving the reception performance of an antenna and a watch having the timer.

SUMMARY OF THE INVENTION

An aspect of this invention is a timer including: a case body made of synthetic resin; an outer case made of synthetic resin, located above the case body and extending to a portion of an upper face of a watch glass; a reinforcement member made of metal embedded in the case body to prevent deformation of the case body when the watch glass is fit thereto and ensure airtightness; and an antenna arranged inside the case body and beneath the reinforcement member, wherein the reinforcement member is embedded in the case body in no electrical continuity with a ground potential.

DETAILED DESCRIPTION

An embodiment of this invention applied to a pointer type watch will be described below with reference to FIGS. 1 to 5.

Figure 1:
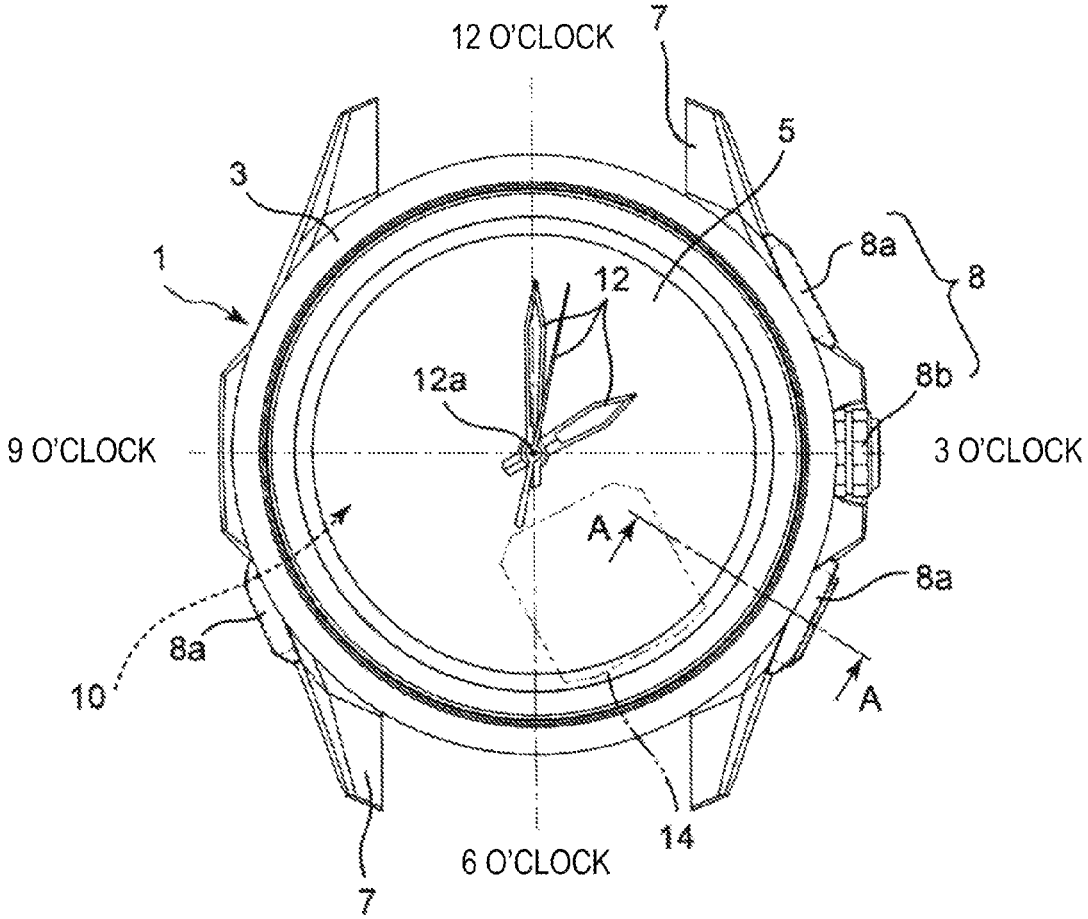
FIG. 1 is an enlarged front view of an embodiment in which the present invention has been applied to a wristwatch.
Figure 2:
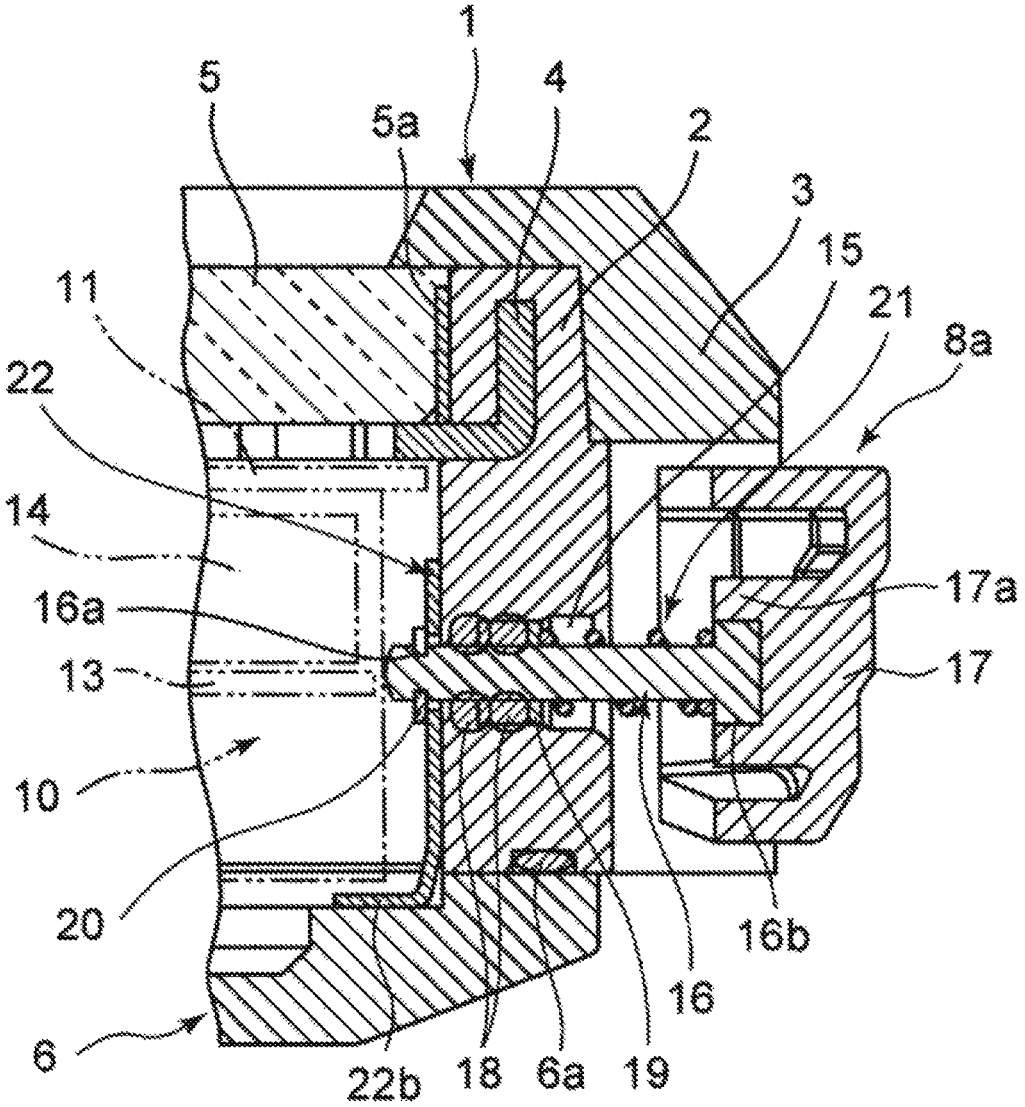
FIG. 2 is an enlarged cross-sectional view of the wristwatch taken along line A-A in FIG. 1.

The watch includes a watch case 1 as illustrated in FIGS. 1 and 2. The watch case 1 includes a case body 2 made of hard synthetic resin, and an outer case 3 made of soft synthetic resin and provided along the outer circumference of the case body 2. In this case, the outer case 3 extends to a portion of the upper face of a watch glass 5. Furthermore, as illustrated in FIG. 2, a reinforcement member 4 made of metal such as stainless steel is embedded in an upper portion of the case body 2 through insert molding.

The watch glass 5 is attached to an upper opening of the watch case 1, that is, an upper opening of the case body 2 with a packing 5*a* therebetween as illustrated in FIGS. 1 and 2. A back cover 6 made of metal is attached to a lower portion of the watch case 1, that is, a lower portion of the case body 2 with a waterproof ring 6*a* therebetween. Furthermore, the outer circumference of the watch case 1 is provided with watch band attachment portions 7 to which a watch band (not illustrated) is attached at positions of 12 o'clock and 6 o'clock.

The outer circumference of the watch case 1 is also provided with multiple switch portions 8 that are operation members as illustrated in FIG. 1. The switch portions 8 include multiple switch buttons 8*a* and one winder 8*b*. The switch buttons 8*a* are switches for selecting various functions such as mode switching of the watch, and provided at positions of 2 o'clock, 4 o'clock, and 8 o'clock along the outer circumference of the watch case 1. The winder 8*b* is used to correct the time, and provided at a position of 3 o'clock along the outer circumference of the watch case 1.

Furthermore, the watch case 1 is provided therein with a watch module 10 as illustrated in FIGS. 1 and 2. The watch module 10 includes a dial 11 arranged at an upper portion thereof, a watch movement (not illustrated) configured to drive hands 12 moving above the dial 11, a circuit board 13 for controlling the entire watch, and an antenna 14 configured to receive radio waves. The antenna 14 is mounted on the circuit board 13, and the ground of the antenna 14 is connected to the ground of the circuit board 13.

In this case, the dial 11 is made of a synthetic resin film, formed in a substantially circular shape, and provided with indices (not illustrated) on the periphery thereof. As illustrated in FIG. 1, the hands 12 include a second hand, a minute hand, and an hour hand, are attached to a hand shaft 12*a* inserted in a through hole (not illustrated) provided at the center of the dial 11, and move above the dial 11 with the rotation of the hand shaft 12*a* to indicate time.

Since the watch movement (not illustrated) that drives the hands 12 are provided at the center of the watch module 10, the antenna 14 is positioned in a region from 3 o'clock to 9 o'clock via 6 o'clock in the watch case 1 to avoid the watch movement as illustrated in FIG. 1, and electrically connected to the circuit board 13 in a state in which the antenna 14 is provided on the circuit board 13 as illustrated in FIG. 2.

Specifically, the antenna 14 receives a radio wave (at 1,575.42 MHz, for example) for a global positioning system (GPS). The antenna 14 has a substantially quadrangular shape in plan view, and arranged at a position corresponding to between the hand shaft 12*a* located at the center of the dial 11 and an end of the dial 11 at 5 o'clock in the watch module 10 as illustrated in FIG. 1.

In this case, as illustrated in FIG. 1, the antenna 14 is arranged at a position between about 4 o'clock and 6 o'clock in a region from 4 o'clock to 8 o'clock via 6 o'clock in the watch case 1, for example, to avoid the watch movement (not illustrated) provided at the center of the watch module 10 in a state close to the inner circumferential surface of the case body 2 and positioned lower than the reinforcement member 4.

Note that the switch buttons 8*a* of the switch portions 8 all have the same structure. Thus, in this embodiment, a switch button 8*a* positioned at 4 o'clock illustrated in FIG. 1 will be described. This switch button 8*a* includes an operation shaft 16 slidably inserted in a through hole 15 provided in the case body 2 of the watch case 1, and an operation head 17 provided at an outer end of the operation shaft 16 as illustrated in FIG. 2.

In this case, the through hole 15 of the case body 2 has a small diameter hole portion 15*a* having a small diameter at an inner end positioned on the inner side of the watch case 1 as illustrated in FIG. 2. In the through hole 15, multiple waterproof rings 18 pressed against the inner circumferential surface of the through hole 15 are provided. The waterproof rings 18 are pressed against the small diameter hole portion 15*a* by a pressing ring 19.

The operation shaft 16 of the switch button 8*a* is made of conductive metal, and has a length longer than the through hole 15 of the case body 2 in the axial direction, such as a length approximately twice as long as that of the through hole 15 as illustrated in FIG. 2. The operation shaft 16 is inserted in the multiple waterproof rings 18 and the small diameter hole portion 15*a* through the pressing ring 19, and in this state, the outer circumferential surface of the operation shaft 16 is slidably pressed in contact with the inner circumferential surfaces of the waterproof rings 18.

In this manner, the operation shaft 16 is adapted to slide in the through hole 15 of the case body 2 along the axial direction thereof in a state in which the waterproof property is ensured as illustrated in FIG. 2. In this case, the inner end of the operation shaft 16 on the inner side of the watch case 1 protrudes inside the watch case 1, a groove 16*a* is annually provided in the protruding portion, and a retaining member 20 such as an E-ring is attached to the groove 16*a*.

The retaining member 20 is made of conductive metal, has an outer diameter larger than that of the small diameter hole portion 15*a* of the through hole 15, and is in contact with the inner surface of the case body 2 located at the outer circumferential edge of the small diameter hole portion 15*a* in a detachable manner as illustrated in FIG. 2. With such a structure, since the retaining member 20 is in contact with the inner surface of the case body 2 at the outer circumferential edge of the small diameter hole portion 15*a* of the through hole 15, the operation shaft 16 is structured not to get out of the watch case 1.

The operation head 17 of the switch button 8*a* is made of conductive metal, and is formed in a substantially cylindrical shape having a diameter sufficiently larger than the inner diameter of the through hole 15 of the case body 2 as illustrated in FIG. 2. The operation head 17 is provided with an attachment portion 17*a* therein, which is attached to the outer end of the operation shaft 16 protruding out of the watch case 1.

In this case, a coil spring 21 is provided between the pressing ring 19 in the through hole 15 of the case body 2 and the operation head 17 as illustrated in FIG. 2. The coil spring 21 is wound around the outer circumference of the operation shaft 16. In this state, one end of the coil spring 21 is in elastic contact with the pressing ring 19 in the through hole 15, the other end thereof is in elastic contact with a large diameter portion 16*b* of the operation shaft 16 attached to the attachment portion 17*a* of the operation head 17, so that the operation shaft 16 is biased toward the outside of the watch case 1.

In this manner, the switch button 8*a* is structured such that when the operation shaft 16 is pressed toward the outside of the watch case 1 by the force of the coil spring 21, the operation head 17 is pressed outside of the watch case 1 in a state in which the retaining member 20 is thus in contact with the inner surface of the case body 2 as illustrated in FIG. 2.

The switch button 8*a* is also structured such that, when the operation head 17 is pressed toward the inside of the watch case 1 against the force of the coil spring 21, the operation shaft 16 slides in the through hole 15 of the case body 2 toward the inside of the case body 2, the retaining member 20 is separated from the inner surface of the case body 2, and the inner end of the operation shaft 16 protrudes inside of the case body 2 to conduct switching operation as illustrated in FIG. 2.

Figure 3:
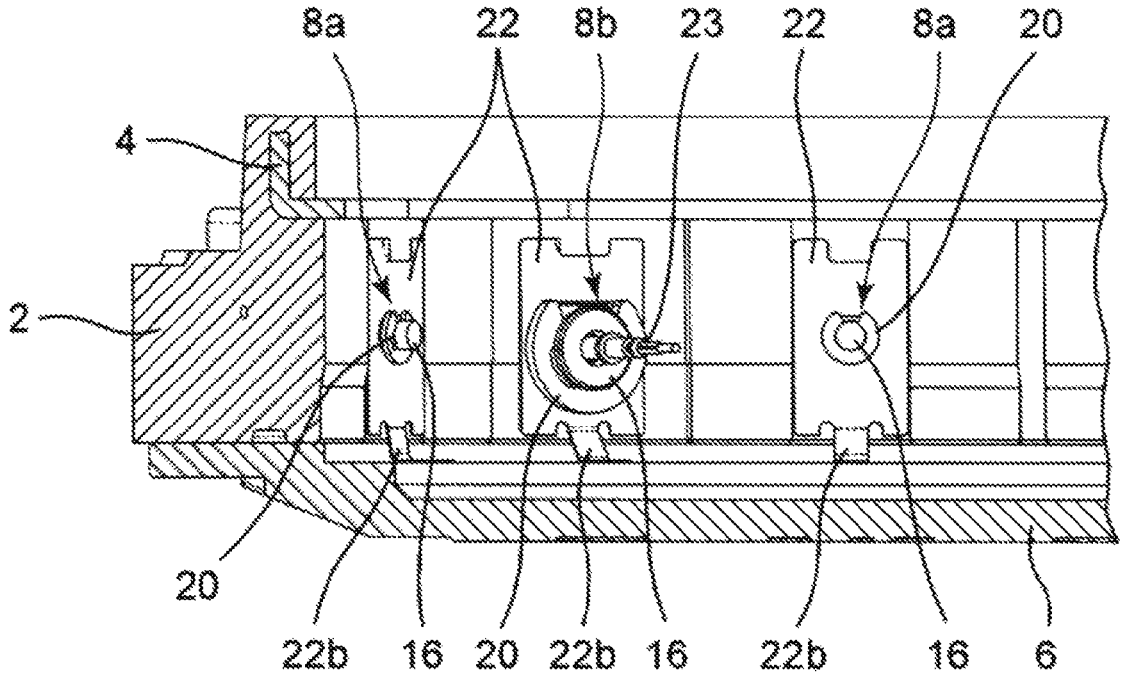
FIG. 3 is an enlarged cross-sectional view of the internal position of the 3 o'clock side of the watch case in FIG. 1.

Furthermore, the switch button 8*a* is electrically connected in electrical continuity with the back cover 6 by a connection member 22 in a state in which the switch button 8*a* is not in electrical continuity with the reinforcement member 4 of the case body 2 as illustrated in FIGS. 2 and 3. Specifically, the connection member 22 is a terminal strip made of conductive metal. The connection member 22 has, at the center thereof, an insertion hole 22*a* into which the operation shaft 16 is inserted in a non-contact state with an inner diameter larger than the outer diameter of the operation shaft 16 of the switch button 8*a* as illustrated in FIGS. 3 and 4.

Figure 4:
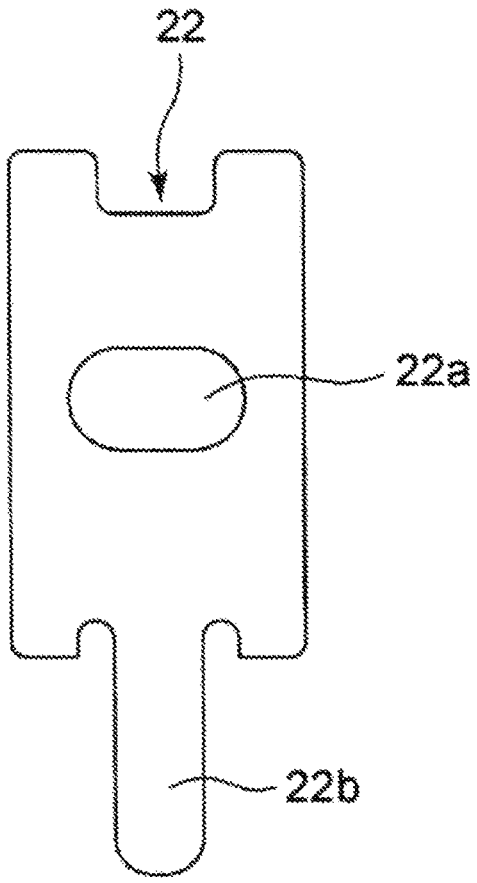
FIG. 4 is an enlarged front-sectional view of the connection member in FIG. 3.

At a lower end that is an end of the connection member 22, a contact 22*b* extends in a bendable manner as illustrated in FIGS. 2 to 4. The connection member 22 is fixed to the inner surface of the case body 2 by an adhesive material or a fixing hook (which are not illustrated). In this manner, the inner end of the operation shaft 16 is inserted in the insertion hole 22*a* in a non-contact state, and the retaining member 20 is attached to the inner end of the inserted operation shaft 16, so that the connection member 22 is arranged between the retaining member 20 and the inner surface of the case body 2.

In this case, when the operation shaft 16 is inserted in the insertion hole 22*a* in a state the connection member 22 is fixed to the inner surface of the case body 2, the connection member 22 is not in contact with the reinforcement member 4 of the case body 2 and the contact 22*b* is bent by the back cover 6 and is in elastic contact with and in electrical continuity with the inner surface of the back cover 6 as illustrated in FIGS. 2 and 3. In this manner, the connection member 22 connects the operation shaft 16 and the back cover 6 in electrical continuity with each other in a state in which the connection member 22 is in non-contact state with the reinforcement member 4 o the case body 2.

Specifically, when the connection member 22 detachably comes into contact with the retaining member 20 attached to the operation shaft 16, the connection member electrically connects the operation shaft 16 and the back cover 6 in electrical continuity with each other by coming in electrical continuity with operation shaft 16 via the retaining member 20 with which the connection member 22 is in contact as illustrated in FIGS. 2 and 3.

Thus, as illustrated in FIGS. 2 and 3, the connection member 22 is structured such that, when the operation head 17 of the switch button 8*a* is pressed against the force of the coil spring 21, the retaining member 20 is detached from the connection member 22 with the sliding movement of the operation shaft 16, so that the electric continuity with the operation shaft 16 is disconnected and the operation shaft 16 and the back cover 6 are disconnected.

The winder 8*b* of the switch portions 8 has a winding stem 23 made of metal as illustrated in FIGS. 1 and 3, and has substantially the same structure as the switch button 8*a* except for the winding stem 23. Specifically, similarly to the switch button 8*a*, the winder 8*b* includes an operation shaft 16 and an operation head 17, the winding stem 23 is attached to the operation shaft 16 in a slidable manner and in a manner rotatable with the operation shaft 16, and the winding stem 23 is connected with the watch movement (not illustrated) in this state.

In this manner, the winder 8*b* is structured such that, when the operation head 17 is drawn out, the operation shaft 16 slides the winding stem 23 accordingly so that the watch movement comes in a time correction state, and when the operation head 17 is rotated in this state, the operation shaft 16 rotates the winding stem 23 accordingly, and the hand shaft 20*a* rotates according to the rotation of the winding stem 23 to correct the time indicated by the hands 12 as illustrated in FIGS. 1 and 3.

In this case as well, a retaining member 20 is attached to the inner end of the operation shaft 16 of the winder 8*b*, a connection member 22 is arranged between the retaining member 20 and the inner surface of the case body 2, and the connection member 22 connects the operation shaft 16 and the back cover 6 in electrical continuity with each other and not in electrical continuity with the reinforcement member 4 of the case body 2 as illustrated in FIG. 3, similarly to the switch button 8*a*.

Note that the reinforcement member 4 of the case body 2 is for reinforcement of the case body 2, is embedded in an upper portion of the case body 2 corresponding to the outer circumference of the watch glass 5, and is positioned above the antenna 14, so that the reinforcement member 4 is arranged in an electrically floating state not connected to the ground potential of the antenna 14 as illustrated in FIG. 2.

Furthermore, an electrode or a dielectric (not illustrated) of the antenna 14 is arranged within a predetermined range (2 mm, for example) from the reinforcement member 4, so that the influence of the reinforcement member 4 on the electric field radiated by the antenna 14 can be reduced, which can reduce degradation in the gain characteristics of the antenna and improve the antenna reception performance.

Figure 5:
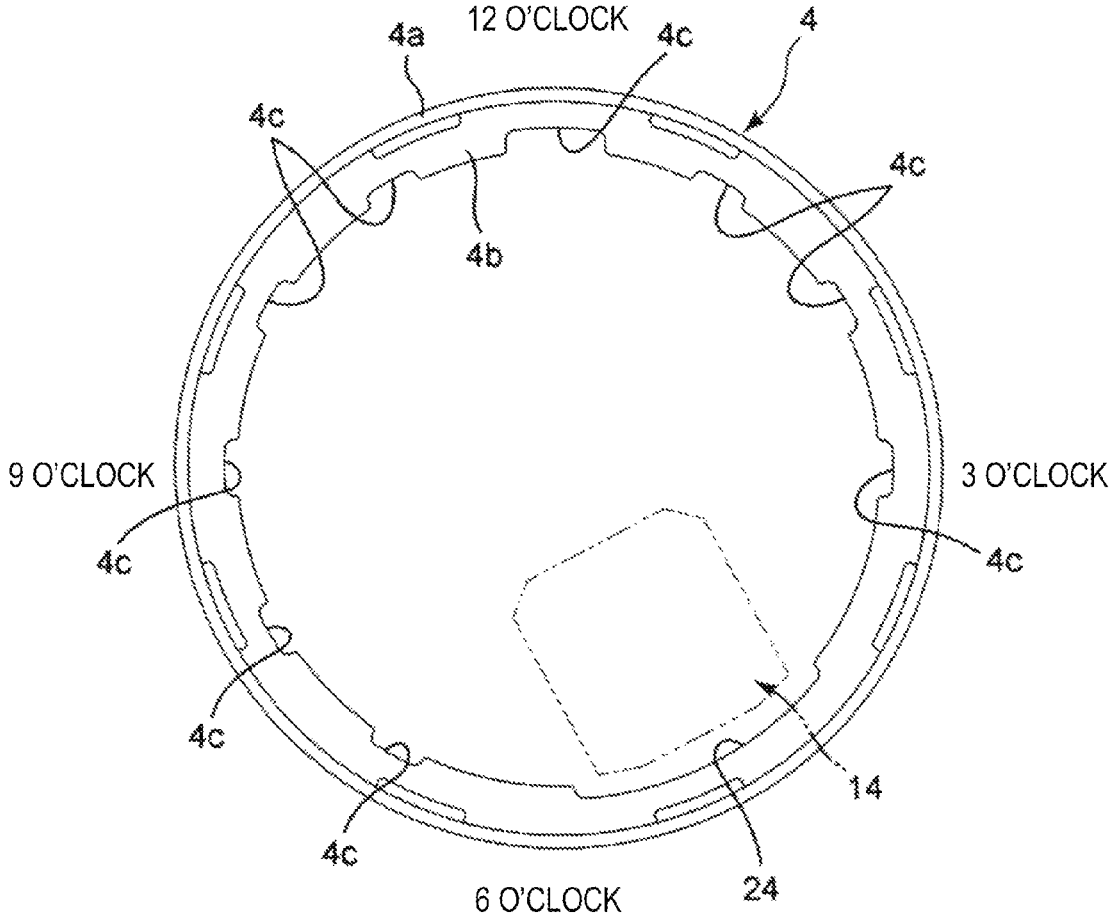
FIG. 5 is an enlarged plane-sectional view of the reinforcement member of the case body in FIG. 2.

Specifically, the reinforcement member 4 has a ring-shaped erect portion 4*a* and a ring-shaped horizontal portion 4*b* with an L-shaped cross section as illustrated in FIGS. 2 and 5. The reinforcement member 4 is embedded in the upper portion of the case body 2 above the antenna 14 through insert molding in a state in which the inner circumferential end of the horizontal portion 4*b* protrudes from the inner surface of the case body 2.

In this manner, the reinforcement member 4 is structured such that, when the watch glass 5 is fit to the upper opening of the case body 2 as illustrated in FIG. 2, the case body 2 is prevented from deformed and air tightness is ensured. In this case, the horizontal portion 4*b* of the reinforcement member 4 is provided with multiple notches 4*c* and a recess 24 at a position corresponding to the position of the antenna 14 as illustrated in FIG. 5.

The recess 24 is formed by cutting off a portion positioned between about 4 o'clock and about 6 o'clock of the horizontal portion 4*b* of the reinforcement member 4 as illustrate in FIGS. 1 and 5. In this manner, the recess 24 is structured such that the reinforcement member 4 can be further separated from the antenna 14 when the antenna 14 receives radio waves, so that the influence of the reinforcement member 4 made of metal on the radio wave reception of the antenna 14 is reduced.

Next, operation of the watch will be described.

When the watch is worn on a wrist for use, the band attachment portion 7 located at the position of 6 o'clock of the watch case 1 is located on the side of the human body, the band attachment portion 7 located at the position of 12 o'clock of the watch case 1 is located opposite to the human body, and the portion of the watch case 1 located at the position of 12 o'clock is opened away from the human body. In this state, the hands 12 move above the dial 11 to indicate the time, which allows the current time to be well visible.

Furthermore, when the antenna 14 receives a radio wave for the GPS in this state, since the position of 6 o'clock of the watch case 1 is located on the side of the human body, the position of 12 o'clock is located on the side opposite to the human body, and the portion of the watch case 1 at the position of 12 o'clock is opened away from the human body, the radio wave for the GPS can be captured at the position of 12 o'clock of the watch case 1 open from the human body and received by the antenna 14 in the watch case 1.

In this case, since the case body 2 is made of synthetic resin, the reinforcement member 4 made of metal is embedded in the case body 2, but the radio wave for the GPS is captured at the position of 12 o'clock of the watch case 1, the influence of the reinforcement member 4 on the reception of the radio wave coming from the side of 12 o'clock of the antenna 14 is reduced when the antenna 14 receives the radio wave, the degradation in the gain characteristics of the antenna 14 in receiving the radio wave is reduced, and the reception performance of the antenna 14 is improved.

Furthermore, in this case, since the recess 24 is provided in the reinforcement member 4 at a position corresponding to that of the antenna 14, the reinforcement member 4 can further be separated from the antenna 14 when the antenna 14 receives the radio wave and the influence of the reinforcement member 4 on the reception of the radio wave by the antenna 14 is also reduced by the recess 24, which can also reduce degradation in the gain characteristics of the antenna 14 in receiving the radio wave and improve the reception performance of the antenna 14.

For switch operation of the switch buttons 8*a*, the operation head 17 of a switch button 8*a* is pressed by a finger. At this point, the operation shaft 16 is pressed toward the outside of the watch case 1 by the force of the coil spring 21, and the retaining member 20 made of conductive metal attached to the operation shaft 16 is in electrical continuity with the connection member 22.

When the finger comes closer to the operation head 17 made of conductive metal in this state, static electricity is generated between the operation head 17 and the finger. The static electricity is conducted from the operation head 17 to the connection member 22 via the operation shaft 16 and the retaining member 20, and can be released to the back cover 6, so that the potential can be dropped to the ground potential.

At this point, the reinforcement member 4 is not in contact with the connection member 22, the connection member 22 and the reinforcement member 4 are not in electrical continuity with each other, and the contact 22*b* of the connection member 22 is in contact with the back cover 6 so that the connection member 22 and the back cover 6 are in electrical continuity with each other. Thus, the static electricity conducted to the connection member 22 is transmitted to the back cover 6 at the ground potential by the contact 22*b* of the connection member 22 without being conducted to the reinforcement member 4. As a result, the electronic circuits in the watch module 10 are prevented from damaged by static electricity.

In this case, the potential of the reinforcement member 4 is not made to be the ground potential by the connection member 22. Thus, since the influence of the reinforcement member 4 on the electric field radiated by the antenna 14 can also be reduced by arranging an electrode or a dielectric (not illustrated) of the antenna 14 within a predetermined range (2 mm, for example) from the reinforcement member 4, the influence of the reinforcement member 4 on radio wave reception of the antenna 14 is prevented when the antenna 14 receives the radio wave, so that the gain characteristics of the antenna 14 is improved and the antenna reception performance of the antenna 14 is improved.

This can also prevent the electronic circuits in the watch module 10 from being damaged by static electricity entering the electronic circuit when the winder 8*b* of the switch portions 8 is operated similarly to operation of the switch button 8*a*.

Furthermore, when the operation head 17 of a switch button 8*a* or the winder 8*b* of the switch portions 8 is pressed against the force of the coil spring 21, the operation shaft 16 slides toward the inside of the case body 2 in the through hole 15 of the case body 2, and the retaining member 20 is separated from the connection member 22 with the sliding movement of the operation shaft 16. As a result, the electrical continuity between the operation shaft 16 and the back cover 6 by the connection member 22 is disconnected, and switch operation can be conducted successfully.

As described above, the watch includes a case body 2 made of synthetic resin, an outer case 3 made of synthetic resin, located above the case body 2 and extending to a portion of an upper face of a watch glass 5, a reinforcement member 4 made of metal embedded in the case body 2 to prevent deformation of the case body 2 when the watch glass 5 is fit thereto and ensure airtightness, and an antenna 14 arranged inside the case body 2 and beneath the reinforcement member 4, in which the reinforcement member 4 is embedded in the case body 2 in no electrical continuity with a ground potential, which can improve the reception performance of the antenna.

Thus, according to this watch, since the reinforcement member 4 is covered by the case body 2 made of synthetic resin and the outer case 3 made of synthetic resin extending to the portion of the upper face of the watch glass 5 above the case body 2, a distance for insulation between the reinforcement member 4 and an object (such as a finger) that is a cause of generation of static electricity can be made sufficient and the influence of the static electricity can thus be eliminated.

Furthermore, according to this watch, the static electricity generated at a switch portion 8 that is an operation member can be released to ground potential by the connection member 22. As a result, since an electronic circuit can be prevented from being damaged by static electricity in the case body 2 and the reinforcement member 4 made of metal that is within a predetermined range from the antenna 14 does not become at the ground potential, degradation in the gain characteristic of the antenna 14 can be reduced and the reception performance of the antenna 14 can be improved.

In this case, since the reinforcement member 4 made of metal is embedded in the case body 2 made of synthetic resin, the reinforcement member 4 can increase the strength of the case body 2. Thus, when the watch glass 5 is fit and attached to the case body 2, deformation of the case body 2 can be prevented by the reinforcement member 4 even when the case body 2 is made of synthetic resin, the airtightness can thus be ensured, and waterproof property under high pressure can be achieved.

Furthermore, according to this watch, since the connection member 22 is connected to the back cover 6 made of metal attached to the back face of the case body 2, static electricity generated between a finger coming close to the switch portion 8 for operating the switch portion 8 and the switch portion 8 can be made to be released to the back cover 6 by the connection member 22 and the potential can be dropped to the ground potential. Thus, the electronic circuits in the case body 2 can be prevented from being damaged by the static electricity.

As a result, since the operation shaft 16 inserted in the through hole 15 of the case body 2 at the switch portion 8 that is an operation member and the operation head 17 attached to the outer end of the operation shaft 16 and protruding to outside of the watch case 1 can both be made of metal, the design of the switch portion 8 is improved and the product value can be improved.

In this case, since the connection member 22 is detachably in contact with the retaining member 20 made of conductive metal and attached to the operation shaft 16 of the switch portion 8 and is brought into electrical continuity with the operation shaft 16 of the switch portion 8 via the retaining member 20, the operation shaft 16 of the switch portion 8 and the connection member 22 can be made to be in continuity with each other via the retaining member 20 in a state in which the retaining member 20 made of metal is in contact with the connection member 22, which can ensure reliable and good electrical continuity between the operation shaft 16 of the switch portion 8 and the back cover 6.

Specifically, since the switch portion 8 includes a coil spring 21 that biases the operation shaft 16 inserted in the through hole 15 in the case body 2 toward the outside of the watch case 1, the operation shaft 16 can normally be pressed toward the outside of the watch case 1 by the force of the coil spring 21.

As a result, since the retaining member 20 made of conductive metal attached to the operation shaft 16 can be made in contact with and in electrical continuity with the connection member 22, it is possible to prevent the electronic circuits in the case body 2 from being damaged by static electricity even when such static electricity is unexpectedly generated at the switch portion 8.

In this case, when the operation head 17 of the switch portion 8 is pressed against the force of the coil spring 21, the operation shaft 16 slides toward the inside of the case body 2 in the through hole 15 of the case body 2, and the retaining member 20 can be separated from the connection member 22 with the sliding movement of the operation shaft 16, which can disconnect electric continuity between the operation shaft 16 and the back cover 6 via the connection member 22.

Furthermore, according to this watch, since the antenna 14 is arranged within a region from 4 o'clock to 8 o'clock via 6 o'clock in the case body 2, the position of 6 o'clock of the watch case 1 can be positioned on the side of the human body and the position of 12 o'clock of the watch case 1 can be positioned on the side opposite to the human body when the watch case 1 is worn on the wrist for use, and the position of 12 o'clock of the watch case 1 can thus be opened from the human body, which can reduce the influence of the reinforcement member 4 made of metal on the reception of a radio wave coming from the side of 12 o'clock, the radio wave coming from the side of 12 o'clock that is opened can be captured, and the radio wave can be successfully received by the antenna 14 in the watch case 1.

Specifically, since the antenna 14 is arranged in a state positioned between about 4 o'clock to and about 6 o'clock in the region from 4 o'clock to 8 o'clock via 6 o'clock in the case body 2, the side of 11 o'clock of the watch case 1 opposed to the antenna 14 can be opened with a good distance from the human body when the watch case 1 is worn on a left wrist for use, which allows a radio wave can to be reliably and successfully captured at the open side of 11 o'clock without being affected by the reinforcement member 4 made of metal, and thus allows the radio wave to be successfully received by the antenna 14 in the watch case 1.

In this case, since a recess 24 is provided in the reinforcement member 4 made of metal embedded in the case body 2 at a position corresponding to that of the antenna 14, the influence of the reinforcement member 4 on the reception of the radio wave by the antenna 14 can be reduced by the recess 24 when the antenna 14 receives the radio wave, which can also reduce degradation in the gain characteristics of the antenna 14 in receiving the radio wave and improve the reception performance of the antenna 14.

Although a case in which the antenna 14 configured to receive a radio wave for the GPS is described in the embodiment described above, the antenna is not limited thereto, and may be an antenna configured to receive a radio wave such as a radio wave of the standard time, a GSM (registered trademark) antenna used for communication using portable telephones, a wireless LAN antenna used for communication in buildings such as a factory and a building, a Bluetooth (registered trademark) antenna used for near field communication, or a combination of these antennas, for example.

Furthermore, although the connection member 22 brings the operation shaft 16 and the back cover 6 into electrical continuity with each other in a state in which the connection member 22 is not in contact with the reinforcement member 4 of the case body 2 in the embodiment described above, the connection member 22 located at a position corresponding to the position of the antenna 14 arranged within the region from 4 o'clock to 8 o'clock via 6 o'clock in the case body 2 may alternatively bring the operation shaft 16 and the back cover 6 into electrical continuity with each other in a state in which the connection member 22 is not in contact with the reinforcement member 4 of the case body 2.

Furthermore, although the connection member 22 connects the switch portion 8 with the ground potential in a state in which the connection member 22 is not in contact with the reinforcement member 4 of the case body 2 in the embodiment described above, the connection member 22 located at a position corresponding to that of the position of the antenna 14 arranged within the region from 4 o'clock to 8 o'clock via 6 o'clock in the case body 2 may alternatively connect the switch portion 8 with the ground potential in a state in which the connection member 22 is not in contact with the reinforcement member 4 of the case body 2.

Although these structures reduce the influence on the electric field radiated by the antenna 14 as compared to a case in which the entire connection member 22 is in contact with the reinforcement member 4, application of the structure of the embodiment described above can achieve better gain characteristics of the antenna.

Furthermore, although a structure in which the operation shaft 16 of a switch portion 8 that is an operation member is provided with the retaining member 20 made of metal and the retaining member 20 detachably comes in contact with the connection member 22 so that the operation shaft 16 and the back cover 6 are brought into electrical continuity with each other by the connection member 22 is described in the embodiment above, the structure is not limited thereto and the connection member 22 may alternatively be brought into direct contact with the operation shaft 16 into electrical continuity with each other so that the operation shaft 16 and the back cover 6 are brought into electrical continuity with each other by the connection member 22.

Furthermore, although a case in which the retaining member 20 is an E-ring made of metal is described in the embodiment above, the retaining member 20 need not necessarily be an E-ring, but may alternatively be a cotter pin made of conductive metal or a pin member made of conductive metal.

Furthermore, although a case in which the recess 24 is formed by cutting off a portion of the horizontal portion 4*b* of the reinforcement member 4 embedded in the case body 2 at a position corresponding to that of the antenna 14 is described in the embodiment above, the recess may alternatively be formed by cutting off a portion of the reinforcement member 4 at a position corresponding to that of the antenna 14.

Furthermore, although an application to a pointer type watch is described in the embodiment above, the invention need not be necessarily applied to a watch but may alternatively be applied to various timepieces such as a travel watch, an alarm clock, a table clock, and a wall clock, for example. The invention need not be necessarily applied to a timepiece but may alternatively be applied to electronic devices such as a portable telephone and a personal digital assistant, for example.

While an embodiment of the invention has been described above, the invention is not limited to the embodiment but includes the scope of the invention defined in the claims and equivalents thereof.

The invention claimed is:

1. A timer comprising:

a case body made of synthetic resin;

an outer case made of synthetic resin, located above the case body and extending to a portion of an upper face of a watch glass;

a reinforcement member made of metal embedded in the case body to prevent deformation of the case body when the watch glass is fit thereto and ensure airtightness; and an antenna arranged inside the case body and beneath the reinforcement member, wherein the reinforcement member is embedded in the case body in no electrical continuity with a ground potential.

2. The timer according to claim 1, wherein the antenna is arranged within a predetermined range from the reinforcement member.

3. The timer according to claim 2, further comprising:

an operation member provided in the case body in an operable manner; and a connection member to connect the operation member with a ground potential in no electrical continuity with the reinforcement member of the case body; wherein the connection member is connected to a back cover made of metal attached to a back face of the case body.

4. The timer according to claim 3, wherein the reinforcement member is provided with a recess at a position corresponding to that of the antenna.

5. A watch comprising the timer according to claim 3.

6. The timer according to claim 2, wherein the antenna is arranged within a region from a position of 4 o'clock to a position of 8 o'clock via 6 o'clock in the case.

7. The timer according to claim 2, wherein the reinforcement member is provided with a recess at a position corresponding to that of the antenna.

8. A watch comprising the timer according to claim 2.

9. The timer according to claim 1, further comprising:

an operation member provided in the case body in an operable manner; and a connection member to connect the operation member with a ground potential in no electrical continuity with the reinforcement member of the case body; wherein the connection member is connected to a back cover made of metal attached to a back face of the case body.

10. The timer according to claim 9, wherein the antenna is arranged within a region from a position of 4 o'clock to a position of 8 o'clock via 6 o'clock in the case.

11. The timer according to claim 9, wherein the reinforcement member is provided with a recess at a position corresponding to that of the antenna.

12. A watch comprising the timer according to claim 9.

13. The timer according to claim 1, wherein the antenna is arranged within a region from a position of 4 o'clock to a position of 8 o'clock via 6 o'clock in the case.

14. A watch comprising the timer according to claim 13.

15. The timer according to claim 1, wherein the reinforcement member is provided with a recess at a position corresponding to that of the antenna.

16. A watch comprising the timer according to claim 1.

* * * * *